US009648959B2

(12) United States Patent
Frydman

(10) Patent No.: US 9,648,959 B2
(45) Date of Patent: May 16, 2017

(54) SINGLE CLASP LEG PILLOW WITH EXTENSION

(71) Applicant: Larry Frydman, Toronto (CA)

(72) Inventor: Larry Frydman, Toronto (CA)

(73) Assignee: Larry Frydman, Ontario (CA)

( * ) Notice: Subject to any disclaimer, the term of this patent is extended or adjusted under 35 U.S.C. 154(b) by 63 days.

(21) Appl. No.: 14/682,395

(22) Filed: Apr. 9, 2015

(65) Prior Publication Data

US 2016/0296030 A1 Oct. 13, 2016

(51) Int. Cl.
*A47C 16/00* (2006.01)
*A47C 20/00* (2006.01)

(52) U.S. Cl.
CPC ..... *A47C 20/021* (2013.01)

(58) Field of Classification Search
CPC ..... A47C 16/00
USPC ..... 5/630, 648, 621, 624, 649–654
See application file for complete search history.

(56) References Cited

U.S. PATENT DOCUMENTS

| | | | | |
|---|---|---|---|---|
| 3,604,023 | A | 9/1971 | Lynch | |
| 4,371,985 | A | 2/1983 | Pokhis | |
| 4,392,489 | A | 7/1983 | Wagner, Sr. | |
| 4,550,459 | A | 11/1985 | Endel et al. | |
| 4,573,456 | A | 3/1986 | Spann | |
| 4,584,730 | A | 4/1986 | Rajan | |
| 4,624,021 | A | 11/1986 | Hofstetter | |
| 4,706,302 | A | 11/1987 | Padfield et al. | |
| 4,736,477 | A | 4/1988 | Moore | |
| 4,805,605 | A | 2/1989 | Glassman | |
| 4,821,355 | A | 4/1989 | Burkhardt | |
| 4,910,818 | A | 3/1990 | Grabill et al. | |
| 5,097,551 | A | 3/1992 | Smith | |
| 5,097,553 | A | 3/1992 | Boland | |
| 5,113,875 | A | 5/1992 | Bennett | |
| 5,125,123 | A | 6/1992 | Engle | |
| 5,173,979 | A | 12/1992 | Nennhaus | |
| 5,216,771 | A | 6/1993 | Hoff | |
| 5,289,828 | A | 3/1994 | Toth | |
| 5,418,991 | A * | 5/1995 | Shiflett | A47C 20/021 5/647 |
| 5,477,866 | A | 12/1995 | Davenport | |
| 5,533,218 | A | 7/1996 | Fahy | |
| 5,664,271 | A | 9/1997 | Bellavance | |
| 5,746,218 | A | 5/1998 | Edge | |
| 6,154,905 | A | 12/2000 | Frydman | |
| 6,182,311 | B1 | 2/2001 | Buchanan et al. | |
| 6,182,314 | B1 | 2/2001 | Frydman | |

(Continued)

FOREIGN PATENT DOCUMENTS

WO 2004062442 A1 7/2004

*Primary Examiner* — Frederick Conley
(74) *Attorney, Agent, or Firm* — The Webb Law Firm

(57) ABSTRACT

A single clasp leg pillow having a removably detachable extension. The single clasp leg pillow includes two bolsters, each having an outer surface and an inwardly directed terminal end, the terminal ends opposing one another to form a single leg clasp. A single thigh channel is defined by the two opposing bolsters and the leg clasp. A bridge having a bottom surface extends between the bolsters. The extension pillow includes an outer surface having a top portion arcuate in shape. The extension pillow further includes a sling configured to envelop the bridge to secure to bottom surface of the bridge to the top portion of the extension.

15 Claims, 4 Drawing Sheets

(56) References Cited

U.S. PATENT DOCUMENTS

| | | | | |
|---|---|---|---|---|
| 6,438,779 | B1 | 8/2002 | Brown | |
| 6,487,736 | B1 | 12/2002 | Militzer | |
| 6,490,742 | B2 | 12/2002 | Hall et al. | |
| 6,578,218 | B2 * | 6/2003 | Wassilefsky | A61G 7/0755 5/630 |
| 6,789,282 | B1 * | 9/2004 | Frydman | A47C 20/021 5/630 |
| 6,859,965 | B1 | 3/2005 | Gourd | |
| 7,051,389 | B2 | 5/2006 | Wassilefky | |
| 7,246,389 | B2 | 7/2007 | Taguchi et al. | |
| 7,415,742 | B2 | 8/2008 | Wassilefsky | |
| 7,469,437 | B2 | 12/2008 | Mikkelsen et al. | |
| 7,530,127 | B2 | 5/2009 | Leifermann et al. | |
| 7,536,735 | B1 | 5/2009 | Stump | |
| 7,634,828 | B2 | 12/2009 | Elhabashy | |
| 7,735,169 | B2 | 6/2010 | Wassilefsky | |
| 8,322,343 | B2 | 12/2012 | Cardin | |
| 8,418,297 | B2 | 4/2013 | Mikkelsen et al. | |
| 8,656,537 | B2 | 2/2014 | Leifermann et al. | |
| 8,863,334 | B2 | 10/2014 | Gibbons et al. | |
| 8,887,333 | B2 | 11/2014 | Cohen | |
| 2008/0092297 | A1 | 4/2008 | Davis et al. | |
| 2012/0110742 | A1 | 5/2012 | Lawler et al. | |
| 2012/0180219 | A1 | 7/2012 | Riccabona | |

* cited by examiner

SINGLE CLASP LEG PILLOW WITH EXTENSION

BACKGROUND OF THE INVENTION

Field of the Invention

The present invention generally relates to an orthopedic support device. More particularly, the present invention relates to an adjustable orthopedic leg support pillow for minimizing spinal stress while an individual is in the lying position.

Description of Related Art

Back pain is the second most common cause for visits to the family doctor, only behind the common cold. Accordingly, proper spinal support has become an area of interest. It is generally known that maintaining proper spinal posture prevents spinal injury and alleviates back pain. The preferred spinal posture includes a slight lordotic curve to the lumbar region of the spine, or what is known as the "neutral spine" position. Maintaining the neutral spine position minimizes the stress placed on the spine and is consequently recommended when performing daily activities. For instance, to reduce the risk of injury while lifting heavy objects, it is advised that an individual maintain the neutral spine position by bending their knees and lifting "with their legs".

Maintaining proper spinal posture while sleeping is also essential. Maintaining proper posture increases comfortableness and results in more restful sleep. Merely lying down is not sufficient for spinal stress reduction.

It is recommended that one avoid the prone position (lying on one's stomach) while sleeping, because of the aggravated stress on the lumbar spine (accentuation of the lordotic curve) and the rotational positioning of the cervical spine, which could result in neck pathomechanics over time. The supine position (lying on one's back) is one preferred sleep position. However, unless there is appropriate flexion at the knee, this position also causes an accentuated lumbar lordotic curve. In other words, when lying on one's back, without some type of leg support, it is natural for the knees to flatten out and for an individual's legs to lie flat on the sleeping surface. In this manner, the legs cooperate with the buttocks to act as a lever that raises the lumbar region of the spine, thereby causing an unnatural accentuation of the lordotic curve that may apply stress to the spine.

Lying on one's side is another preferred sleep position. Without the appropriate support, however, the lumbar spine has a tendency to be affected by rotational stresses due to torquing forces between the upper and lower body. In the side-lying position, the legs of the individual are generally maintained in an overlying relationship to one another. Positioning the legs in this manner, along one side of the body, causes the body to compensate for this position, which may result in stress on the spine.

Several devices have been proposed to alleviate stress placed on a spine of an individual while sleeping. Such devices include large pillows or other support devices that an individual may place between their upper thighs in a side-lying position. These pillows extend out and away from the front and back areas of the individual to block, or prevent the user from rolling over. Such devices are well known in the art and a variety of such pillows are commercially available.

One problem associated with these devices arises from the natural tendency of people to roll or shift positions while sleeping. Such movement can cause the pillows to shift from in-between the thighs, thereby causing the user to awaken in order to readjust the pillow or forego its support providing purpose. To overcome some of these problems, U.S. Pat. No. 5,216,771 proposed a leg pillow essentially hourglass in shape having two concave regions opposite one another that receive the inner thighs of an individual in a side-lying position, or for placing under the legs while lying in the supine position. Further, U.S. Pat. No. 6,154,905, proposed a pillow having two concave regions for receiving the inner thighs of an individual.

These pillows do not resolve the described deficiency as they lack the ability to firmly clasp onto an individual's leg for a secure, non-slip fit. Moreover, the pillows are incapable of substantially conforming to the unique contours of an individual's legs. U.S. Pat. No. 6,789,282 (incorporated by reference herein), proposed a single clasp leg pillow having a single thigh channel defined by two opposing bolsters. The single clasp leg pillow only partially resolves the problems associated with the state of the art.

Like a vast majority of the products on the market, the single clasp device is main-streamed for a bulk of the population. As all individuals vary anatomically and each individual has personal preferences, the customization of spinal support products to all individuals would be impractical, if not impossible. Methods of customization for both the cervical and lumbar spine have been attempted through intricate systems of support that are adjustable via inflatable means and fluid-filled means. From a manufacturing perspective, these methods can be costly. Moreover, these products do not consider the specific needs of the individual user.

For these reasons, a need exists for a cost effective and adjustable orthopedic pillow that is capable of providing sufficient support to varying sizes of individuals, and is further capable of customizing to an individual's needs, as opposed to the individual conforming to the product.

The present invention overcomes the problems associated with the prior art as the orthopedic support device disclosed herein provides a secure, non-slip comfortable support that is capable of customizing to the particular needs of an individual and provides a removably detachable extension to provide additional support for individuals that may not fall within the median stature of the population.

SUMMARY OF THE INVENTION

A primary object of the present invention is to provide a customized orthopedic leg support device that has a natural, secure, and comfortable fit that can be utilized to support and maintain the natural spinal alignment of individuals of varying size while reclining in a side-lying position.

It is yet another object of the present invention to provide a customized orthopedic leg support device which maintains the normal anatomical position of the lower limbs when side-lying in order to minimize stress on the lumbar spine, sacroiliac joints, and femoral acetabular joints.

These and other objects of the present invention are achieved by providing a single clasp leg pillow having a removably detachable extension. The single clasp leg pillow includes two opposing bolsters, each having an outer surface and an inwardly directed terminal end. The terminal ends oppose one another to form a single leg clasp. A single thigh channel is defined by the two opposing bolsters and the leg clasp. The single clasp leg pillow further includes a bridge extending between the bolsters having two flex channels to facilitate pivotal movement of the bolsters with respect to the bridge. The extension pillow includes an outer surface having a top portion and a bottom portion. The top portion and the bottom portion being arcuate in shape. The arcuate shape of the bottom portion being of greater curvature than the arcuate shape of the top portion. Terminal ends of the top portion and the bottom potion intersect to define two terminal edges. The extension further includes a sling secured to a first side of the outer surface and a second side of the outer surface defining a gap between the top portion of the extension and the sling. The sling is configured to envelop the bridge of the leg pillow.

The invention also includes a method of providing orthopedic support to the user reclining in a side-lying position. The method includes enveloping a sling of the extension around a portion of the leg pillow to secure the extension underneath the leg pillow; positioning the leg pillow having two bolsters, a bridge, and a single thigh channel adjacent a first thigh of the user; pivoting at least one of the bolsters outward to open the thigh channel and inserting the first thigh within the thigh channel adjacent the bridge; clasping the first thigh in the thigh channel with a friction fit upon resilient return of the at least one pivoted bolster toward its original position; and positioning the first thigh and a bottom portion over a second thigh and lowering the first thigh to thereby place a bottom portion of the extension on the second thigh and flexing the bridge and the bolsters with respect to one another to conform the leg pillow to the first thigh and to conform the extension pillow to the second thigh.

BRIEF DESCRIPTION OF THE DRAWINGS

Other objects and advantages of the invention will become apparent from the following detailed description taken in conjunction with the accompanying drawings, in which.

DETAILED DESCRIPTION OF THE INVENTION

For purposes of the description hereinafter, spatial orientation terms relate to the embodiment of the invention, as it is oriented in the accompanying drawing figures. Further, it is to be understood that the invention may assume many alternative variations and embodiments, except where expressly specified to the contrary. It is also to be understood that the specific devices and embodiments illustrated in the accompanying drawing figures and described herein are simply exemplary embodiments of the invention.

The invention is embodied in a leg support device 10 comprising two removably detachable components, including a single clasp leg pillow 12 and an extension 13. The single clasp leg pillow 12 may be used alone or in conjunction with the extension 13 and both components are preferably manufactured as separate pieces of countered polyurethane foam.

Figure 1:
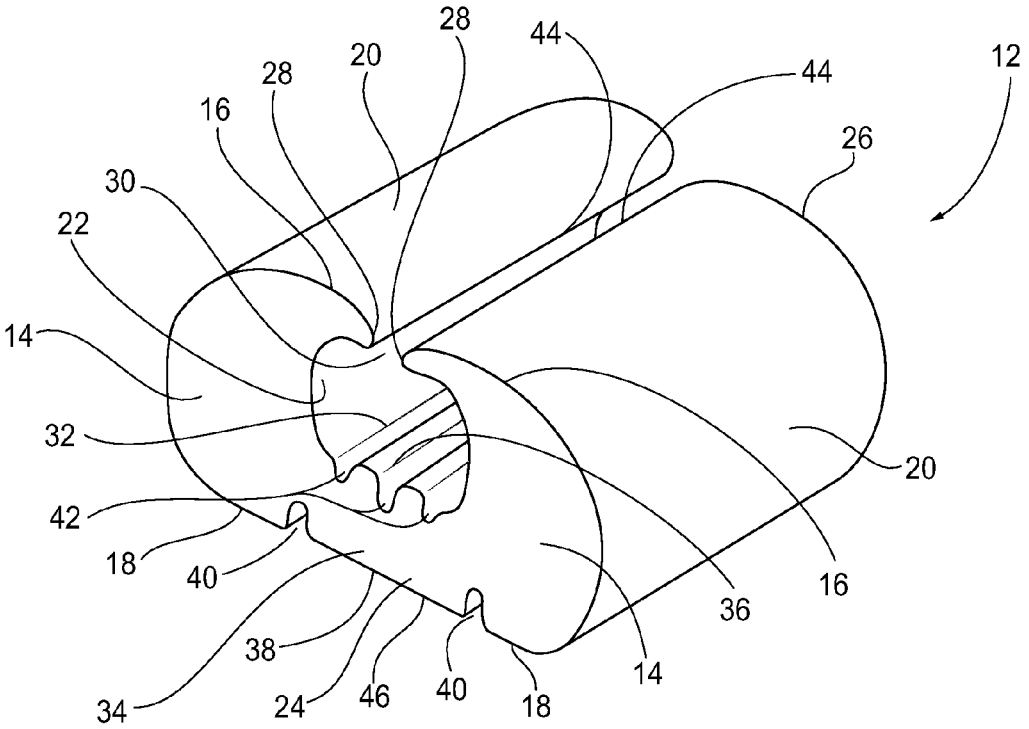
FIG. 1 is a perspective view of a single clasp leg support pillow.
Figure 2:
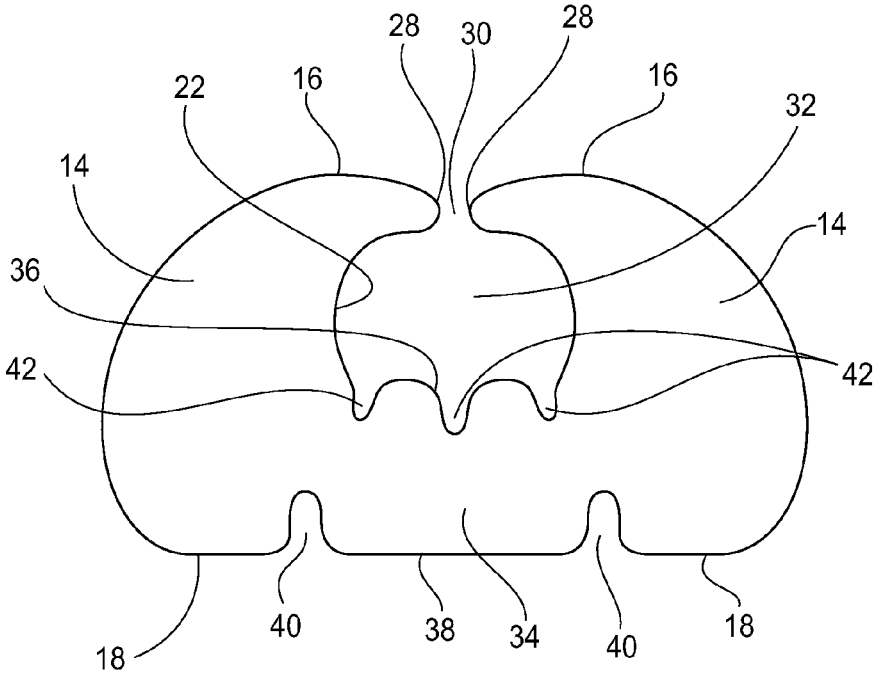
FIG. 2 is a front view of the single clasp leg support pillow shown in FIG. 1.

Referencing FIGS. 1-2, the single clasp leg pillow includes two opposing bolsters 14 have an upper surface 16, a planar lower surface 18, an arcuate outer surface 20, and an inner surface 22. The single clasp leg pillow 12 further has a front side 24 and a back-side 26. The upper surfaces 16 of the bolsters 14 are inwardly directed to form two terminal ends 28. The terminal ends 28 oppose one another to form a single leg clasp 30. The inner surface 22 of each bolster 14 and the leg clasp 30 define a thigh channel 32 that is generally C-shaped and has an arc of curvature of at least 270°. Extending between and connecting to the two bolsters 14 is a bridge 34 that has an upper surface 36 and a planar lower surface 38. The planar lower surface 38 lies opposite the thigh channel 32. Included within the lower planar surface 38 of the bridge 34 are two flex channels 40, each one located between a respective bridge 34 and its adjacent bolster 14. Provided on the upper surface 36 of the bridge 34 are three spaced airflow channels 42. The two outer airflow channels 42 lie generally opposite the two flex channels 40.

Thus configured, the single clasp leg pillow 12 presents the appearance of two bolsters 14 generally having convex outer surfaces 20 that curve upward and inward to form respective terminal ends 28. The inner surfaces 22 of the bolsters 14 define a rotated, C-shaped thigh channel 32, wherein the opening forms the leg clasp 30 that is defined by the two terminal ends 28 of the bolsters 14. The two terminal ends 28 extend along the single clasp leg pillow 12 from the front side 24 to the back side 26 to form resilient fingers 44 configured to firmly clasp an individual's thigh, as described in greater detail below. The thigh channel 32 extends across the single clasp leg pillow 12 from the front side 24 to the back side 26 with an opening at the upper surface 16 of the bolsters 14. The lower planar surfaces 18 of the bolsters 14 are preferably coplanar with the lower planar surface 38 of the bridge 34 to form an essentially flat bottom surface 46. Provided within the flat bottom surface 46 are the two flex channels 40 that extend along the single clasp leg pillow 12 from the front side 24 to the back side 26.

Figure 3:
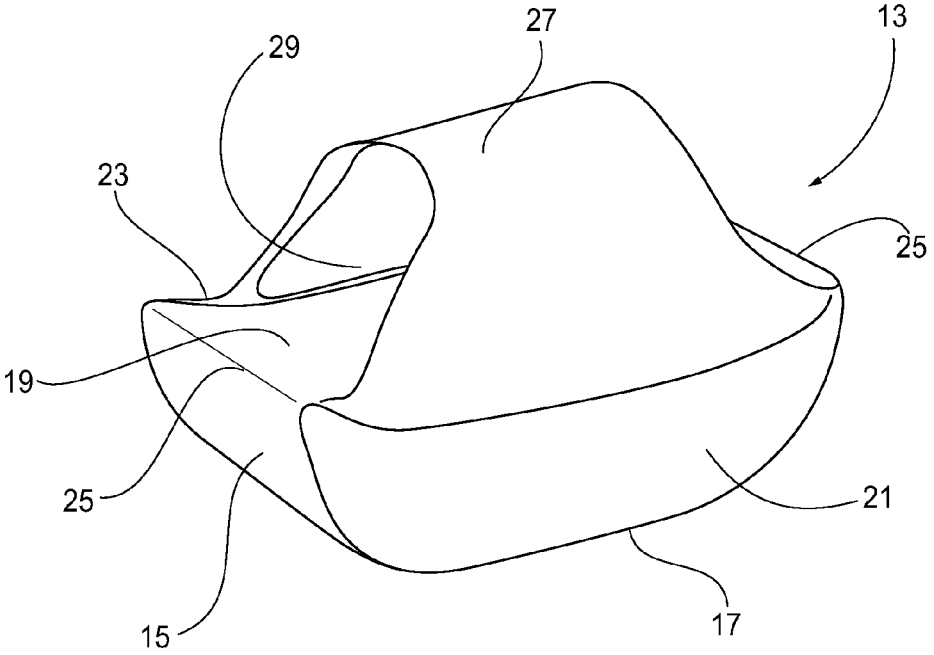
FIG. 3 is a perspective view of an extension.

Referencing FIG. 3, the adjustable extension 13 includes an outer surface 15 having an essentially planar bottom portion 17 and a top portion 19. The adjustable extension 13 further has a front side 21 and a back side 23. The top portion 19 and the bottom portion 17 are arcuate in shape, the arcuate shape of the bottom portion 17 being of greater curvature than the arcuate shape of the top portion 19. Terminal ends of the top portion 19 and the bottom potion 17 intersect to define two terminal edges 25. The adjustable extension further includes a sling 27. The sling 27 is preferably made from an elastic material. The sling 27 is affixed to the outer surface 15 of the adjustable extension 13 at the edge of the top potion 19 and the front side 15 and the edge of top portion 19 and the back side 23 defining a gap 29 between the sling 27 and the top portion 19. The gap 29 extends between the terminal edges 25.

Figure 4:
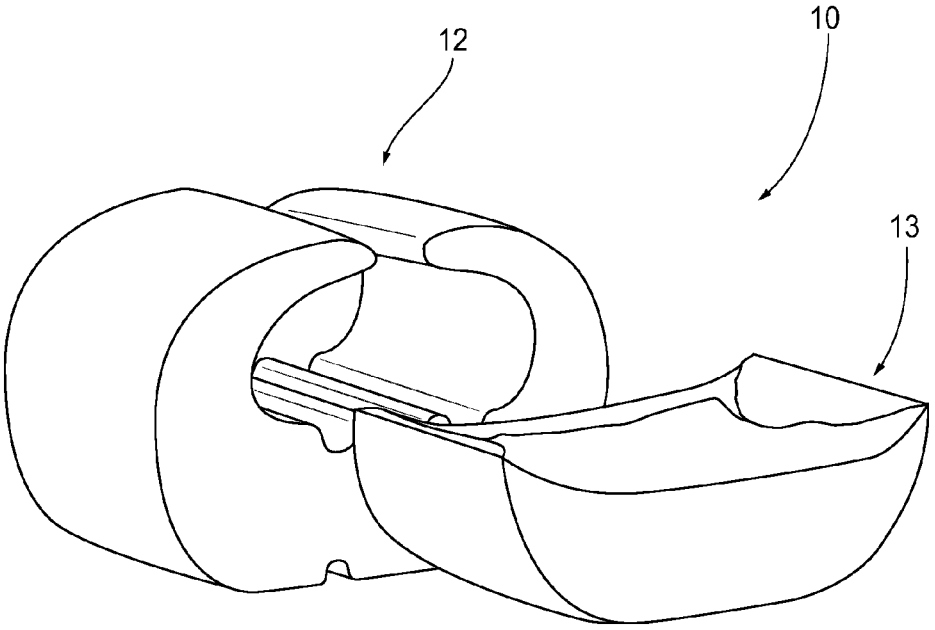
FIG. 4 is a perspective view of the single clasp leg support pillow shown in FIG. 1 and the extension shown in FIG. 3, where the extension is not secured to the single clasp leg support pillow.
Figure 5:
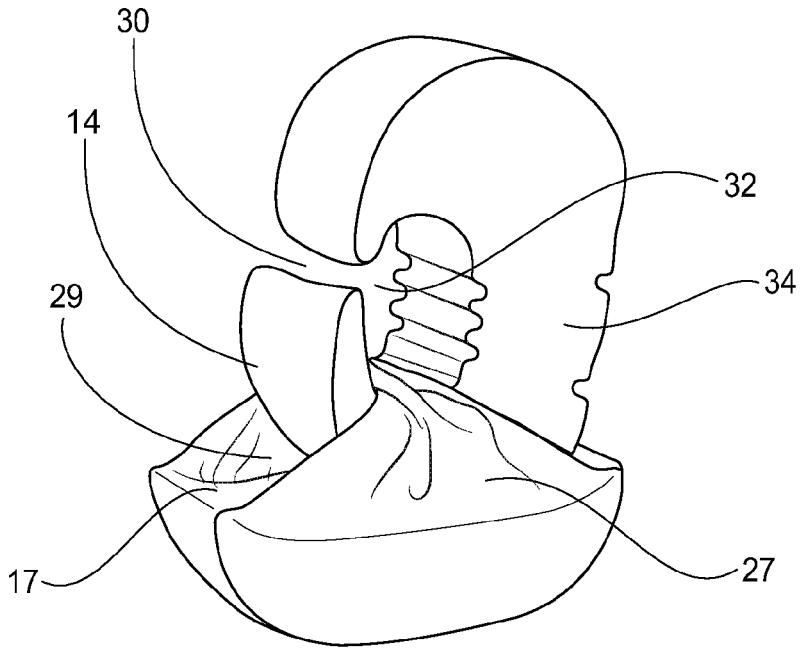
FIG. 5 is a perspective view of the single clasp leg support pillow and extension system shown in FIG. 4, where the extension is being secured to the leg support pillow.
Figure 6:
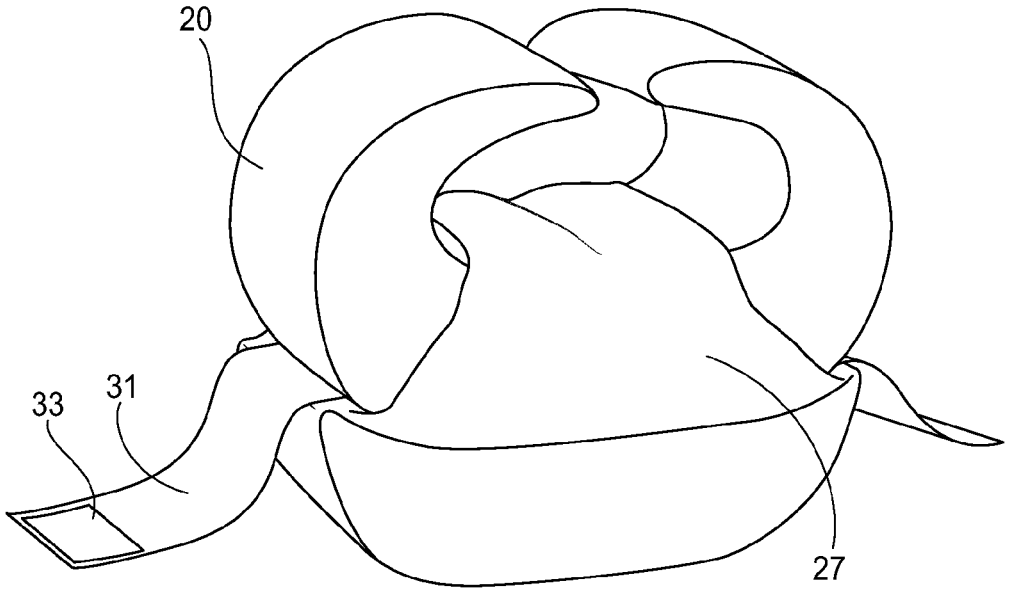
FIG. 6 is a perspective view of the single clasp leg support pillow and extension pillow shown in FIG. 4, where the extension has been secured to the single clasp leg support pillow.

Referencing FIGS. 4-6, the leg support device 10 comprises two components that are removably detachable from one another. With specific reference to FIG. 4, the single clasp leg pillow 12 may be completely detached from the extension 13 and used by itself to reduce spinal stress while in a side-lying position. The single clasp leg pillow 12 may optionally be fastened to the extension 13. The removably detachable feature provides the user with adjustability. The extension 13 is particularly advantageous for individuals of larger statute or for individuals who require that their top knee be held a greater vertical distance above their bottom knee to provide proper spinal support.

If the user desires, the user may secure the single clasp leg pillow 12 to the top portion of the extension 13. In order to secure the components one of the bolsters 14 is placed into the gap 29. The sling 27 is then positioned between the leg clasp 30 so that it extends through the thigh channel 32, as shown by FIG. 5. In the secured configuration shown in FIG. 6, some of the features discussed hereinafter are unable to be seen due to the configuration. For completeness, cross-reference FIGS. 1 and 3. The bottom surface 46 of the single clasp leg pillow lies on the top portion 19 of the extension 13 and the upwardly curved terminal edges 25 of the extension 13 partially enclose around the arcuate outer surface 20 of the bolsters 14. In this position, the elastically stretched sling 27 envelops the central bridge 34 securely compressing the single clasp leg pillow 12 to the top of the extension 13.

In another embodiment, the leg support device 10 may include an elastic belt 31. The elastic belt 31 includes a fastening means 33 such as Velcro. The belt 31 is configured to be threaded through one or more belt loops 35 located on the lower planar surface, as shown in FIG. 2. The elastic belt 31 may be wrapped and stretched around the arcuate outer surface 20 of the single clasp leg pillow 12 and fastened using the Velcro 33 to prevent the bolsters 14 from separating. The belt 31 may be utilized when the single clasp leg pillow 12 is used alone or when the leg pillow 12 is used in conjunction with the extension 13.

Figure 7:
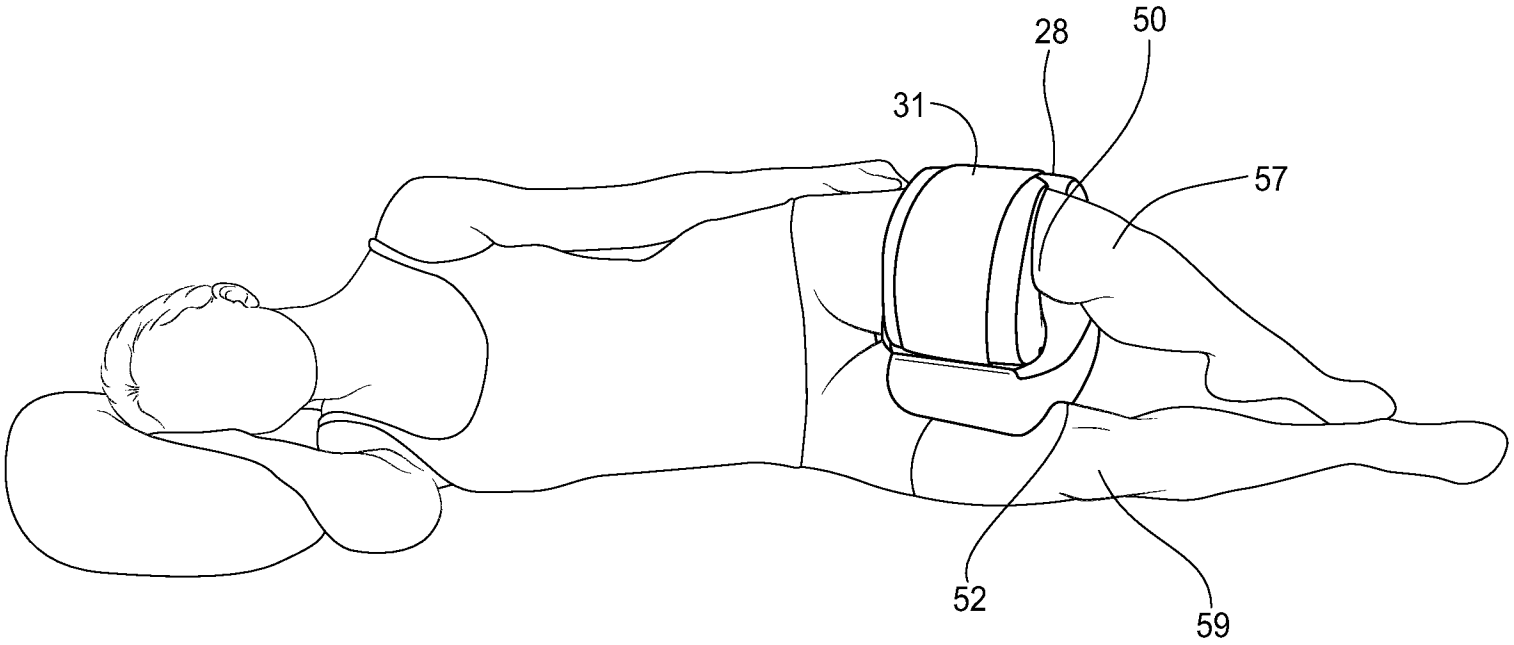
FIG. 7 is a perspective view of the single clasp leg support and extension pillow shown in FIG. 6 being used while an individual is in the side-lying position.

The leg support device 10 can be used to reduce spinal stress while in the side-lying position, as shown in FIG. 7, because some of the features discussed hereinafter are not able to be shown in this configuration, please cross-reference FIGS. 1 and 3 for completeness. The first inner thigh 50 of an individual is placed within the single leg clasp 30 of the leg pillow 12 and the second inner thigh 52 is placed in the center of the bottom portion 17 of the extension 13 (or the center of the lower planar surface 38 of the bridge 34, if used without the extension 13). The single leg clasp 30 includes deformable, resilient terminal ends 28 which, when forced to spread apart, provide an opening for the receipt of the first inner thigh 50 of an individual. The terminal ends 28, when released, are resilient and thus return to their original position thereby clasping the first inner thigh 50 in a secure, contoured engagement with a friction fit. The bolsters 14 pivot (via flex channels 40) to allow for insertion and removal of the thigh from the thigh channel 32.

The lower planar surface 38 of the bridge 34 is deformable and resilient as a result of the two flex channels 40 contained therein allowing the bridge 34 to conform to the contours of the individual's thighs. Particularly, when the inner thigh 50 engages the upper surface of the bridge 36 and simultaneously the top portion 19 of the extension (or the second inner thigh 52, if used without the extension 13) engages the planar lower surface 38 the bridge 34 will compress. Flex channels 40 permit the bolsters 14 to pivot with respect to the bridge 34, and the planar lower surface 38 thus conforms to the top portion 19 of the extension 13 (or the second inner thigh 52, if used without the extension 13). Likewise, the upper surface 36 of the bridge 34 is compressed so as to conform to the first inner thigh 50. The single clasp leg pillow 12 thus conforms to the unique contours of the individual's lower body anatomy and resists disengagement from tossing and turning by the individual.

Once in place, the arcuate-shaped bolsters 14 extend out from the front and back sides of the individual reclining in a side-lying position, as shown in FIG. 7. The bulk of the two bolsters 14 are of sufficient size and rigidity to resist any action of the sleeping individual attempting to roll over onto the prone or supine positions. The leg clasp 30 and the belt 31 act together in securing the single clasp leg pillow into position around the thigh 50, thus preventing the thigh from dislodging from the thigh channel 32. The airflow channels 42 further improve comfortableness by preventing moisture and temperature build-up on the thighs. The bridge 34 produces a gap between the thighs that resists the natural tendency of the upper knee 57 to lie on top of the lower knee 59. The gap between the knees, preferably 2 to 4 inches, relieves the torsional stress on the spine created by the undesired rotation of the upper leg. The extension 13 provides the user with means to adjust the size of the gap between the knees to provide comfort and proper support to individuals of differing sizes. Thus, the leg support device 10 not only prevents rotation by the individual into an undesirable prone position, but also reduces spinal stress while in the side-lying position by placing a comfortable, and adjustable, amount of space between the upper knee 57 and the lower knee 59 to naturally align the spine.

While the present invention has been described with respect to the presently preferred embodiment, it is not intended that such details be regarded as limitations upon the scope of the invention.

The invention claimed is:

1. An extension pillow removably connectable to a separate leg pillow for adjusting a distance between an individual's knees, the extension pillow comprising:

an outer surface having a top portion and a bottom portion, wherein the top portion and the bottom portion are arcuate in shape, the arcuate shape of the bottom portion being of greater curvature than the arcuate shape of the top portion, and wherein terminal ends of the top portion and the bottom portion intersect to define two terminal edges; and a sling secured to a first side of the outer surface and a second side of the outer surface defining a gap between the top portion of the extension and the sling, wherein the gap defines a first opening and a second opening and is adapted to receive and secure the separate leg pillow.

2. The extension pillow of claim 1, wherein the terminal edges are located a vertical distance above the top portion and wherein, the terminal edges partially enclose a bottom surface of the leg pillow when the extension is attached to the leg pillow.

3. The extension pillow of claim 1, wherein the sling is configured to envelop a portion of a leg pillow to secure the leg pillow to the extension.

4. The extension pillow of claim 3, wherein the portion is a central bridge located between two bolsters.

5. The extension pillow of claim 1, wherein the sling is made from an elastic material.

6. The extension pillow of claim 1, wherein the pillow is made from polyurethane foam.

7. A single clasp leg pillow with extension, comprising:

a leg pillow comprising:

two opposing bolsters, each having an outer surface and an inwardly directed terminal end, the terminal ends opposing one another to form a single leg clasp;

a single thigh channel defined by the two opposing bolsters and the leg clasp;

a bridge extending between the bolsters, opposite said leg clasp, having an upper surface and a planar lower surface; and two flex channels in said leg pillow to facilitate pivotal movement of the bolsters with respect to the bridge; and an extension pillow comprising:

an outer surface having a top portion and a bottom portion, wherein the top portion and the bottom portion are arcuate in shape, the arcuate shape of the bottom portion being of greater curvature than the arcuate shape of the top portion, and wherein terminal ends of the top portion and the bottom potion intersect to define two terminal edges; and a sling secured to a first side of the outer surface and a second side of the outer surface defining a gap between the top portion of the extension and the sling, the gap defining a first opening and a second opening, wherein the sling is configured to removably secure the leg pillow to the extension pillow when the leg pillow at least partially extends through the first and second openings.

8. The single clasp leg pillow with extension of claim 7, further comprising a belt to prevent the bolsters from separating.

9. The single clasp leg pillow with extension of claim 8, wherein the belt further comprises Velcro.

10. The single clasp leg pillow with extension of claim 7, wherein the terminal edges are located a distance above the top portion and wherein, the terminal edges partially enclose a bottom surface of the leg pillow when the sling envelops the bridge.

11. The single clasp leg pillow with extension of claim 7, wherein the thigh channel defined by said bolsters is C-shaped, said thigh channel having an arc of curvature of at least 270°.

12. A method of providing orthopedic support to a user when in a side-lying position providing an extension pillow and a leg pillow with a single thigh channel, comprising:

enveloping a sling of the extension around a portion of the leg pillow to secure the extension underneath the leg pillow;

positioning the leg pillow having two bolsters, a bridge, and a single thigh channel adjacent a first thigh of the user;

pivoting at least one of the bolsters outward to open the thigh channel;

inserting the first thigh within the thigh channel adjacent the bridge;

clasping the first thigh in the thigh channel with a friction fit upon resilient return of the at least one pivoted bolster toward its original position;

positioning the first thigh and a bottom portion over a second thigh;

lowering the first thigh to thereby place a bottom portion of the extension on the second thigh; and flexing the bridge and the bolsters with respect to one another to conform the leg pillow to the first thigh and to conform the extension pillow to the second thigh.

13. The method of claim 12, further comprising fastening a belt around the leg pillow to prevent the first thigh from dislodging from the thigh channel.

14. The method of claim 13, wherein the belt is fastened by Velcro.

15. The method of claim 12, including the step of resisting by means of the bolsters any action of the user attempting to roll over into the prone or supine position.

* * * * *